US006557541B2

(12) United States Patent
Pinto, Jr.

(10) Patent No.: US 6,557,541 B2
(45) Date of Patent: May 6, 2003

(54) ARROW STABILIZER FOR ARCHERY BOW

(76) Inventor: Julian P. Pinto, Jr., 721 Grove Rd., Thorofare, NJ (US) 08086

( * ) Notice: Subject to any disclaimer, the term of this patent is extended or adjusted under 35 U.S.C. 154(b) by 0 days.

(21) Appl. No.: 09/950,170

(22) Filed: Sep. 10, 2001

(65) Prior Publication Data

US 2002/0059926 A1 May 23, 2002

Related U.S. Application Data

(63) Continuation-in-part of application No. 09/461,588, filed on Dec. 15, 1999, now abandoned.

(51) Int. Cl.[7] ..... F41B 5/22
(52) U.S. Cl. ..... 124/44.5; 124/24.1
(58) Field of Search ..... 124/24.1, 44.5

(56) References Cited

U.S. PATENT DOCUMENTS 4,351,311 A 9/1982 Phares
5,025,773 A * 6/1991 Hintze et al. ..... 124/44.5
5,042,450 A 8/1991 Jacobson
5,253,633 A 10/1993 Sisko
5,456,242 A * 10/1995 Ruholl ..... 124/44.5
5,460,153 A * 10/1995 Huntt ..... 124/44.5
5,529,049 A * 6/1996 Antalosky ..... 124/44.5
5,676,121 A * 10/1997 Bizier ..... 124/44.5
5,896,849 A * 4/1999 Branthwaite et al. ..... 124/44.5
6,082,348 A * 7/2000 Savage ..... 124/44.5

* cited by examiner

*Primary Examiner*—John A. Ricci
(74) *Attorney, Agent, or Firm*—John R. Merkling

(57) ABSTRACT

An arrow support for supporting an arrow in an archery bow. The arrow support provides a simple, compact, lightweight and non-bulky apparatus that corrects distortion induced in the arrow upon its release by the archer. Single screws provide secure, non-rotating connections where adjustments are to be made. A planar ring has locking apparatus extending through the ring to lock support members in place using a single adjustment. The planar ring has a scalloped inner surface, accommodating a range of fletches, with a minimal outside diameter of the ring. Silencers are provided on at least some of the support members to suppress sounds as an arrow is drawn into a shooting position.

29 Claims, 5 Drawing Sheets

ARROW STABILIZER FOR ARCHERY BOW

CROSS REFERENCE TO RELATED APPLICATIONS

This application is a continuation-in-part application of U.S. patent application Ser. No. 09/461,588, filed Dec. 15, 1999 now abandoned. The disclosure of application Ser. No. 09/461,588 is incorporated herein by reference.

BACKGROUND OF THE INVENTION

The present invention relates generally to the field of archery, and more particularly to arrow stabilizers and rests for supporting an arrow in an archery bow. A simplified and improved apparatus is provided for improving the accuracy and safety of an archery bow.

Arrows are typically supported within an archery bow by a generally horizontal plate located above a handgrip area of the bow. The rest plate or member is typically integrally formed as part of the bow apparatus. Although the support plate provided as part of most archery bows does support the arrow in a generally horizontal position relative to the ground, such plates do not prevent the shaft of the arrow either from sliding laterally off the plate or from shifting from the generally horizontal position to an angled position when the arrow is nocked, drawn or released. Either type of movement will compromise the safety and accuracy of the bow.

Arrow rests for archery bows typically perform a number of functions. In addition to providing support for the arrow when it is nocked and drawn, the rest also guides the arrow as it is released from the bow, and may provide a degree of compensation for arrow flex or distortion, which occurs as the energy from the drawn bow is transferred to the arrow. Ideally, an arrow rest should absorb little or no energy from the arrow as it is released. Any energy absorbed by the rest is a loss of energy that could be transferred to the arrow, reducing both the range and accuracy with the arrow may be shot.

Arrow distortion occurs when an arrow deflects from its rest (i.e., unloaded) shape as it absorbs energy from the bow following its release by the archer. Two types of distortion are known. Inherent distortion is a consequence of how the bow and/or the arrow are manufactured. Applied distortion, on the other hand, is created intentionally by mounting the arrow rest slightly off the optimum line of force for the bow, or by mounting the bowstring nock point above or below the optimum line of force. Applied distortion has been used to ensure that the arrow will clear the rest upon release from the bow. Distortion may occur in either the horizontal or vertical planes, or a combination of the two. Whether created inadvertently or intentionally, however, and regardless of the plane(s) in which it acts, arrow distortion in undesirable because it results in a loss of energy transferred from the bow to the arrow, with corresponding reduction in accuracy and distance for the archer.

Inconsistencies inherent in aiming and releasing an arrow from an archery bow make the amount of energy lost to a typical arrow rest highly unpredictable. A number of variables affecting energy loss may differ slightly from one arrow release to another. The angle of the arrow in both the vertical and horizontal planes may be different. The archer may draw the bow a few millimeters or centimeters more or less than the prior or subsequent shot. There may be slight differences in when the archer releases the bowstring with the upper and lower fingers relative to one another. Moreover, during a single archery session, the mechanical movement of the bow itself may lead to changes in bowstring tension and other mechanical properties of the bow. The foregoing factors all influence how much energy is lost by an arrow as it contacts the rest during release.

Because of the unpredictable nature of energy losses to an arrow rest, it is desirable that the arrow rest provide a minimum of contact with the arrow during shooting.

The present invention provides an archery rest with a simple, non-bulky, light-weight design that reduces or eliminates distortion. Further, the design provides improved safety both in the field and on the shooting range.

A number of archery rests are known in the art. A first type of archery rest includes a diaphragm member or brushes for closely supporting an arrow shaft around substantially its entire periphery. U.S. Pat. No. 5,460,153 includes a tubular member having a diaphragm at the tube end nearest the bowstring. The diaphragm closely engages the shaft of an arrow and includes three slots to enable the vanes of the arrow to pass through the diaphragm. A bracket connects the tubular member to the riser of an archery bow.

U.S. Pat. No. 5,896,849 includes a ring member having a plurality of radially disposed bristles, which engage the shaft of an arrow along substantially its entire periphery. The lower portion of the ring member is supported within a clamp member, and a bracket member connects the ring/clamp assembly to the riser of a bow.

Rests of the foregoing type are undesirable because of the relatively high level of contact between the support diaphragm or brushes and the shaft and vanes of the arrow during its release from the bow. Such contact results in significant loss of energy transmitted to the arrow. Further, arrow distortion and release inconsistencies by the archer make the amount of energy lost to the rest as a result of the contact highly unpredictable, with a corresponding reduction in accuracy to the archer. Moreover, such rests provide essentially no correction of distortion because no biasing force is provided to the shaft of the arrow.

Other rests include a tubular member for enclosing or partially enclosing the shaft of an arrow. Some tubular rests include one or more biasing members for reducing distortion. Biasing members contact the arrow and provide a biasing force acting generally normal to the shaft of the arrow to return it to its unloaded, rest state. U.S. Pat. No. 5,042,450 to Jacobson discloses a tubular arrow rest having three resilient fingers attached for contacting the arrow. The fingers are mounted on the end of the tube nearest the bowstring, and they are angled in the direction of arrow travel. Adjustable finger springs may be provided to increase or decrease the force applied to the arrow by the fingers. A bracket connects the assembly to the riser of an archery bow, and a threaded rod connects the tubular member to the bracket.

U.S. Pat. No. 5,253,633 to Sisko discloses a partially tubular arrow rest in which a slot is provided running the length of the bore. The slot allows an arrow to be inserted into the rest from the side rather than the ends of the tubular member. Three spring-loaded biasing members are provided for contacting the arrow and correcting distortion. The biasing members are mounted in a single plane generally normal to the bore of the tube. The springs of the biasing members may be changed to alter the biasing force applied to an arrow; however, a top biasing member extending generally downward from the top of the tube preferably has a smaller applied force than two bottom biasing members. A pair of adjustable, L-shaped brackets is provided to connect the partially tubular member to the riser of an archery bow.

Tubular rests such as those disclosed in the Jacobson and Sisko patent serve to protect the hand and arm of the archer from inadvertent contact with the arrow. Tubular rests create a relatively high risk of inadvertent contact of the arrow with the tube because of the increased tube length through which the arrow must pass either before or after contacting the biasing members, depending upon their location along the length of the tube. Contact of the arrow with the tube reduces the accuracy of the arrow, and in cases of severe distortion may actually increase the risk of injury to the archer. The reduction in accuracy and increased risk of injury are greater in the case of highly distorted arrows. Moreover, the risk of contact between the arrow and the tube increases with increasing tube length. For relatively long tubular rests, even a small departure from a precisely coaxial alignment of the arrow with the bore of the tube may result in contact between the arrow and the tube, especially where distortion is present.

It is an object of the present invention to provide an adjustable arrow rest that is simple in design and easy to use, yet provides improved safety and accuracy.

It is a further object of the invention to provide an arrow rest that is lightweight and non-bulky, and which can effectively be used for both hunting and range archery.

It is also an object of the present invention to provide an arrow rest that avoids the use of tubular members and the associated risk of contact between the tube and the arrow.

Another object of the invention is to provide an arrow rest that can be easily adjusted with a minimum of parts.

Another object is to provide an arrow rest with increased clearance for fletches.

A further object of the invention is to provide and arrow rest with silencers that dampen sounds made as an arrow is being drawn in a bow. These and other features and objects of the invention will be apparent from the following description and accompanying drawings.

SUMMARY OF THE INVENTION

This invention provides an archery rest for improving the safety and accuracy of an archery bow. More specifically, the present invention provides an arrow stabilizer and support apparatus coupled to the riser of an archery bow. The apparatus supports an arrow placed within it, stabilizes the flight of the arrow by correcting distortion following release of the arrow by the archer, and provides protection for the archer from potential injury from the arrow.

The arrow stabilizer and support apparatus includes a planar ring member coupled to the riser of the bow and adjustably positioned such that the plane of the ring is generally perpendicular to the axis of an arrow placed within the bow. Arrows may be easily inserted into the apparatus through either side of the central opening of the planar ring member. Pluralities of spring-loaded plungers, coplanar with the ring member, are provided for contacting an arrow placed within the ring member. In addition to providing support for the arrow, the spring-loaded plungers correct distortion during the shooting process and protect the archer from possible injury from the arrow. The spring-loaded plungers extend from the interior periphery of the ring along lines passing through the center of the ring member. Accordingly, the spring-loaded plungers maintain the shaft of the arrow generally at the center of the ring member and exert a force upon the arrow generally perpendicular to its shaft.

The plungers may be constructed as provided in U.S. Pat. No. 5,253,633 to Sisko, discussed above, the contents of which are hereby incorporated by reference herein. However, the actual construction of the spring-loaded plungers may differ from those disclosed by Sisko without departing from the spirit and scope of the invention, as will be appreciated by those of skill in the art.

A bracket member is provided to couple the ring member to the riser of an archery bow. The bracket member may be adjustably moved with respect to the riser of the bow along the direction of travel of an arrow. The ring member may be moved laterally with respect to the bracket member. The bracket member and ring member together allow the apparatus to be adjustably customized to the position desired by the archer.

DESCRIPTION OF THE DRAWINGS

The invention may be understood by reference to the following description taken in conjunction with the accompanying drawings, in which like reference numerals identify like elements.

Figure 1:
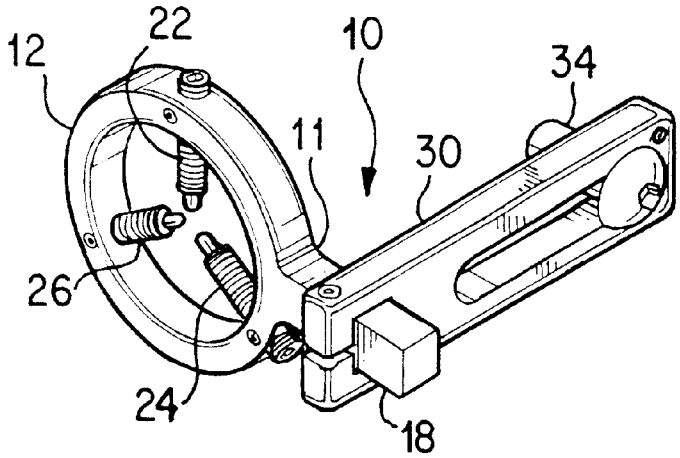
FIG. 1 is a perspective view of an embodiment of the arrow rest of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

FIGS. 1–6 depict an archery rest apparatus according to the present invention, designated generally as rest 10. In addition to providing support for an arrow 40 placed within an archery bow (not shown), the archery rest 10 corrects distortion following the release of the arrow 40, and protects the archer from potential injury from the arrow 40. Rest 10 is coupled to the riser of an archery bow.

Rest 10 includes a ring member 11 coupled to a support bracket 30. As shown more clearly in FIG. 2 and FIGS. 7–10, ring member 11 provides a generally planar ring 12 having a central opening 13 through which an arrow 40 is inserted. Ring member 11 also includes a ring support arm 18 for coupling the planar ring 12 to the support bracket 30. Rest 10 is preferably mounted to the archery bow such that the plane of ring 12 is generally perpendicular to an arrow placed through central opening 13. A first side 14 of planar ring 12 is oriented facing the bowstring of the bow, and a second side 16 is oriented to face the riser of the bow. Ring 12 further includes an exterior periphery 15 and an interior periphery 20.

Ring 12 is preferably as thin as possible, i.e., the distance D (FIGS. 7, 9) between first side 14 and a second side 16 is preferably minimized to reduce the likelihood of contact between ring member 12 and an arrow released from the bow. Ring 12 is preferably of sufficient thickness D to support spring-loaded plungers 22, 24, and 26 within holes 23, 25, and 27 provided in ring 12, although it will readily be appreciated that spring-loaded plungers 22, 24, and 26 could be supported by nuts or like structures coupled to first side 14 or second side 16 of ring 12. In a preferred embodiment, ring member 11 and ring 12 have the same thickness, which preferably ranges from 0.1 inches to 1 inch. In a particularly preferred embodiment the thickness D of the ring 12 is about 0.31 inches.

Ring member 11 and ring 12 are preferably made from lightweight metal alloys or plastics, although any material may be used so long as the ring 12 has sufficient rigidity to avoid significant flexing during release of an arrow from the bow. In a preferred embodiment the ring member 11 and ring 12 are made from anodized aluminum.

The ring member 11 further includes a plurality of spring-loaded plungers 22, 24, 26 (FIG. 2) coupled to ring 12. Spring-loaded plungers 22, 24, 26 are generally cylindrical in shape, and may be constructed as provided in U.S. Pat. No. 5,253,633, although the specific construction may vary, so long as the plungers are spring-loaded for contacting the shaft of an arrow 40. The spring-loaded plungers 22, 24, 26 extend from inner periphery 20 of ring 12 (FIG. 5) into the central opening 13 of the ring 12, preferably along lines passing through the center P (FIG. 8) of ring 12. The plungers 22, 24, 26 include tip members 19 (FIG. 2) which contact an arrow 40 held in the archery bow. The tips may be constructed of materials for minimizing noise, friction, and wear contact with the arrow. In a preferred embodiment, Delrin® tips are used for aluminum arrows, and steel tips for carbon arrows.

Figure 2:
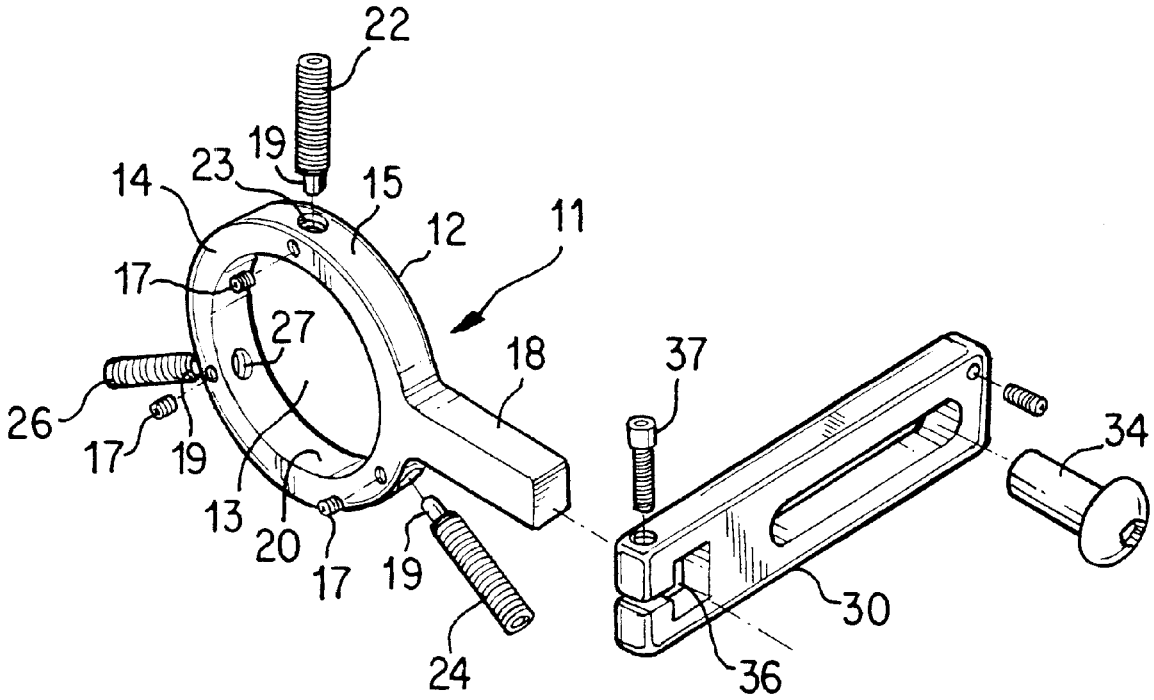
FIG. 2 is an exploded view of the embodiment of the arrow rest of FIG. 1.
Figure 4:
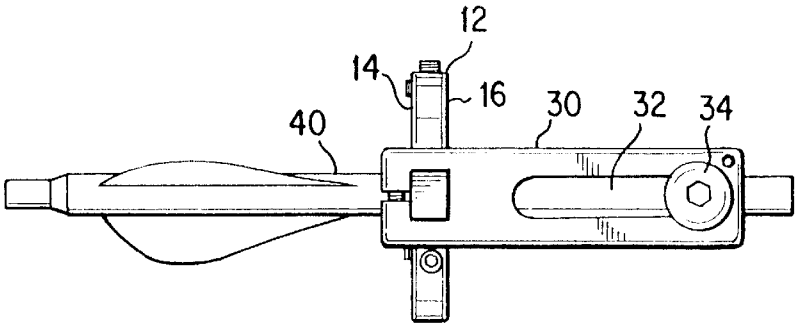
FIG. 4 is a side view of the arrow rest of FIGS. 1–3.
Figure 6:
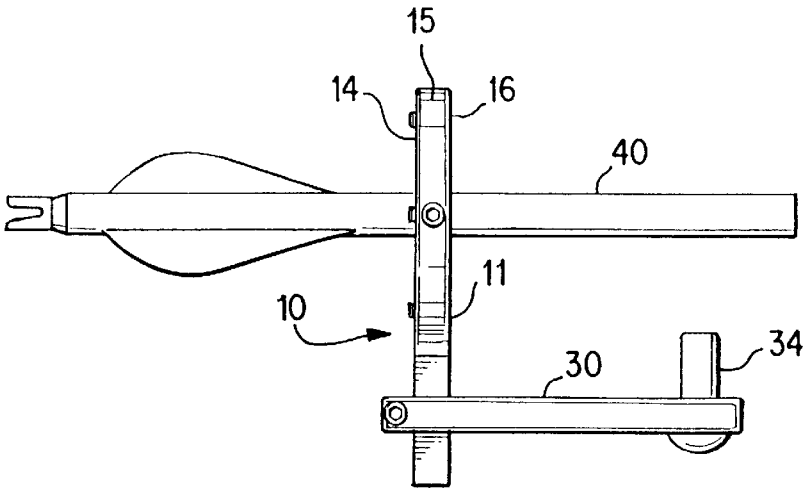
FIG. 6 is a top plan view of the arrow rest of FIG. 3, showing an arrow inserted through the planar ring of the rest.
Figure 3:
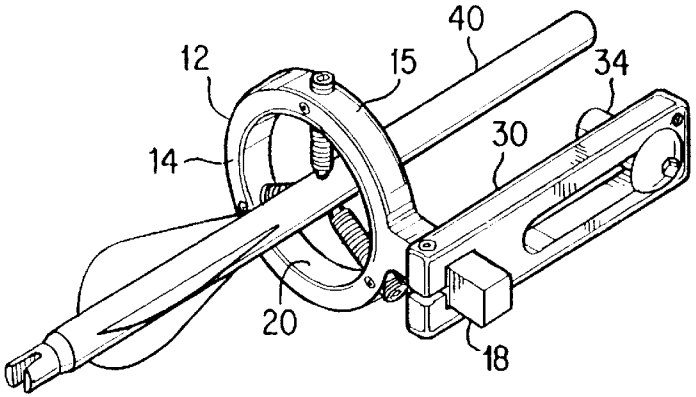
FIG. 3 is a perspective view of an arrow rest according to the present invention showing an arrow inserted through the planar ring of the rest.
Figure 5:
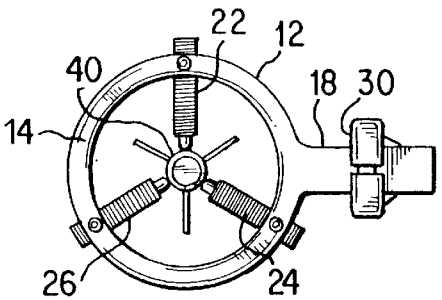
FIG. 5 is a front elevation view of the arrow rest of FIG. 3, taken from the rear of the bow and looking toward the front of the bow, and showing an arrow inserted through the planar ring of the rest.
Figure 8:
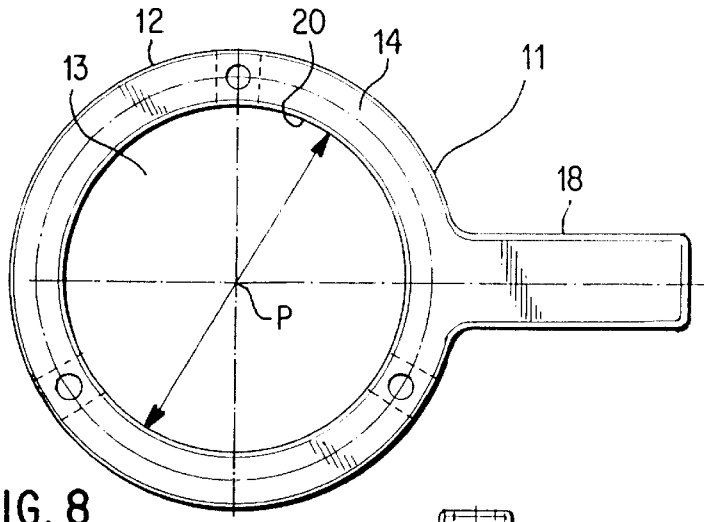
FIG. 8 is a front view of the ring member of FIG. 7.
Figure 10:
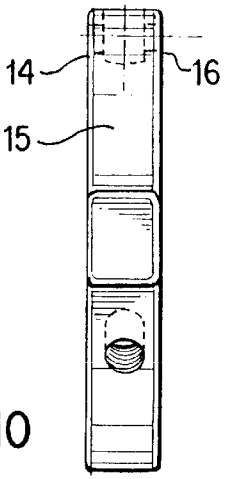
FIG. 10 is a side view of the ring member of FIG. 7.
Figure 7:
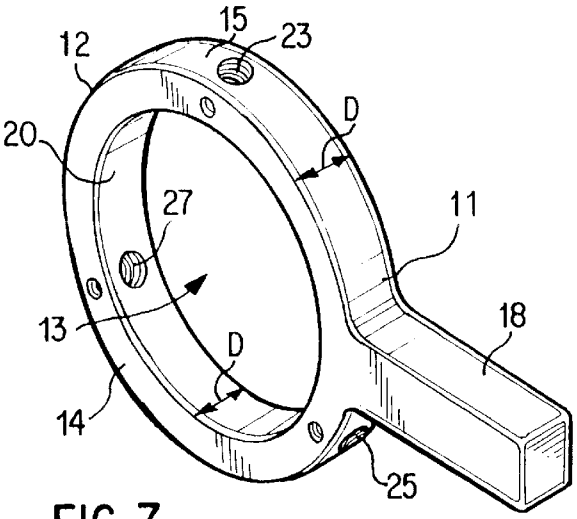
FIG. 7 is a perspective view of a ring member of an arrow rest according to the present invention.
Figure 9:
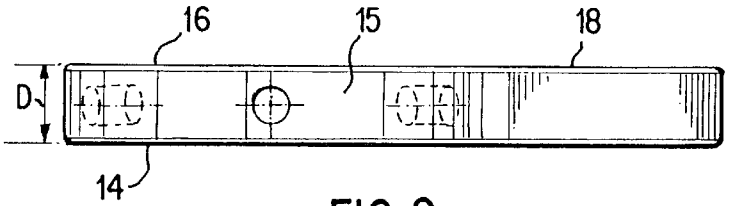
FIG. 9 is a top plan view of the ring member of FIG. 7.
Figure 12:
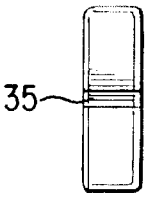
FIG. 12 is a front view of the support bracket of FIG. 11.

As shown more particularly in FIGS. 1 and 2, the plungers 22, 24, 26 may be coupled to ring 12 by a threaded connection, although other connecting means may be employed, as persons of skill in the art will appreciate. In the embodiment depicted in FIGS. 1–6, the exterior of spring-loaded plungers 22, 24, 26 are provided with threads that engage corresponding threads in holes 23, 25, 27 in ring 12. Holes 23, 25, and 27 extend from the exterior periphery 15 of ring 12 to the interior periphery 20. The holes preferably orient spring-loaded plungers 22, 24, 26 on lines passing through the center of ring 12. One hole is provided for each of the spring-loaded plungers. The plungers 22, 24, 26 may be locked in a desired location by locking screws 17, which engage plungers 22, 24, 26 through holes in the first side 14 of ring 12 and prevent the plungers from being moved in holes 23, 25, 27. Preferably the locking screws 17 have deformable elastomeric tips that contact the threads of the plungers 22, 24, 26 without damaging the threads of the plungers. For example, stainless steel set screws with nylon tips are available from MSC Industrial Supply Company.

Although the number of spring-loaded plungers is not critical to the invention, it is preferred that the number of plungers be restricted to avoid excessive contact between the plungers and the arrow, which would adversely affect accuracy and distance. It is preferred that from two to five plungers be provided. More preferably, three such plungers are provided.

As shown more particularly in FIGS. 2 and 7–10, ring support arm 18 of ring member 11 is preferably coplanar with ring 12, such that ring member 11 forms a single plane. However, it will be readily appreciated that ring support arm 18 may be located out of the plane of ring 12 without departing from the spirit and scope of the invention. Further, although the ring support arm 18 depicted in the embodiment of FIGS. 1–2 and 7–10 is illustrated as a straight member having a generally square cross-section, the shape and cross-section of ring support arm 18 may also be altered without departing from the scope of the invention.

As shown more clearly in FIG. 2, support arm 18 engages support bracket 30 through aperture 36. Details of a preferred embodiment of support bracket 30 are provided in FIGS. 11–14. Aperture 36, located near a first end 31 of bracket 30, is shaped to cooperate with the cross-sectional shape of support arm 18. Aperture 36 can preferably act as a clamp to securely fasten support arm 18 to support bracket 30. As shown particularly in FIGS. 1 and 14, a slot 35, from the aperture 36 to the first end 31 of bracket 30, provides a clamping action for aperture 36 to engage support arm 18. Threaded holes 38 are provided transverse to and on either side of said slot, and a threaded screw 37 is provided for engaging said holes to tighten aperture 36 and engage support arm 18. Although a clamping arrangement has been provided for coupling the support arm 18 to the support bracket 30, it will be readily appreciated that other means may be employed without departing from the scope of the invention.

Support arm 18 may be securely fastened to support bracket 30 anywhere along the length of the support arm. Accordingly, ring 12 may be adjusted laterally with respect to an arrow 40 held within the rest 10. Ring 12 may be adjusted in the direction of arrow travel by means of an adjustment slot 32, provided generally near a second end 33 of support bracket 30. An attachment bolt 34 (FIG. 2) is provided to adjustably secure the support bracket 30 to the riser of the archery bow (not shown). Attachment bolt 34 fits within adjustment slot 32 and attaches to the riser of the archery bow. By sliding slot 32 relative to attachment bolt 34 before tightening the bolt, the support bracket 30 (and thus ring 12) may be adjusted toward or away from the riser of the archery bow. Adjacent the slot 32, a setscrew 36 extends through the support bracket 30. The setscrew 36 contacts the riser of the archery bow and prevents the support bracket 30 from rotating around the attachment bolt 34.

Figure 14:
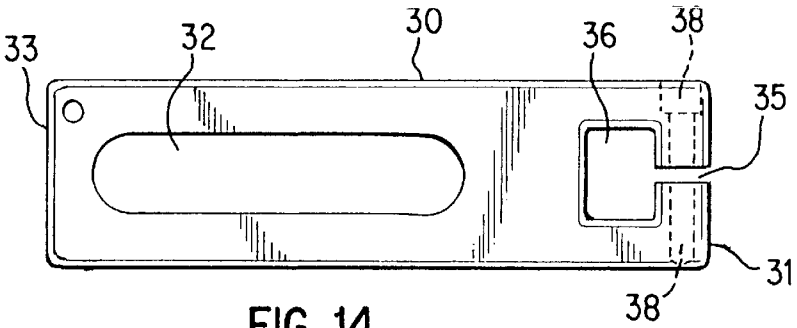
FIG. 14 is a side view of the ring member of FIG. 7.
Figure 11:
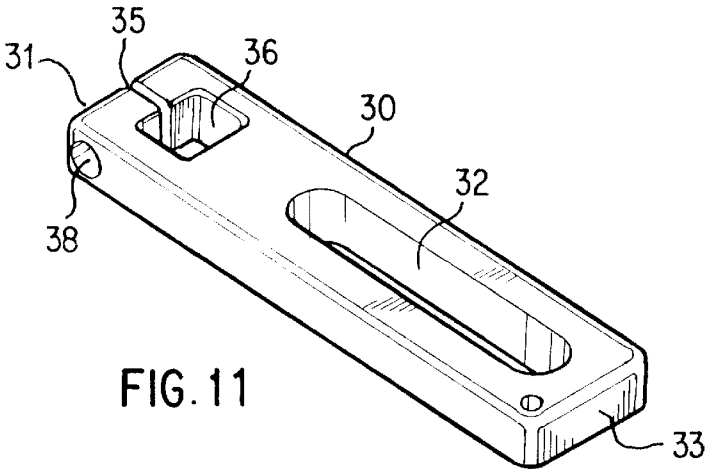
FIG. 11 is a perspective view of a support bracket of an arrow rest according to the present invention.
Figure 13:
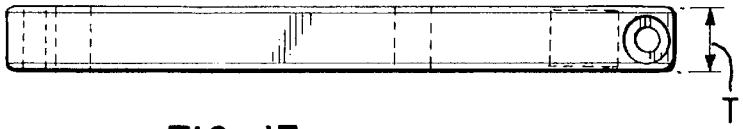
FIG. 13 is atop plan view of the support bracket of FIG. 11.

Support bracket 30 is preferably made from rigid but lightweight metal alloys, but it may also be made from rigid plastics. In a preferred embodiment, support bracket 30 is preferably made from anodized aluminum. Support bracket 30 is preferably sufficiently thick to provide rigidity to rest 10 when in use. In a preferred embodiment, support bracket 30 includes a thickness T (FIG. 13) of between about 0.1 and about 0.75 inches, more preferably about 0.25 inches. Although a slot mechanism is shown in FIGS. 2 and 14 for adjusting the ring 12 along the direction of arrow travel, other means may be used without departing from the scope of the invention.

Figure 15:
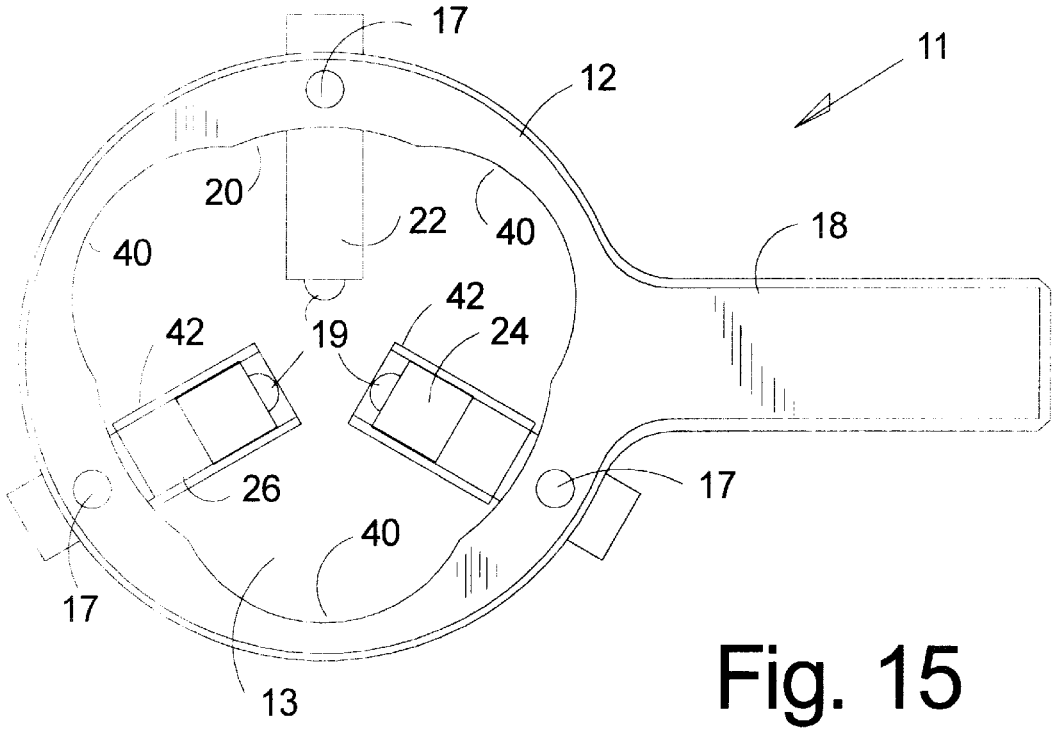
FIG. 15 is a plan view of a ring member of an arrow rest according to the present invention.
Figure 16:
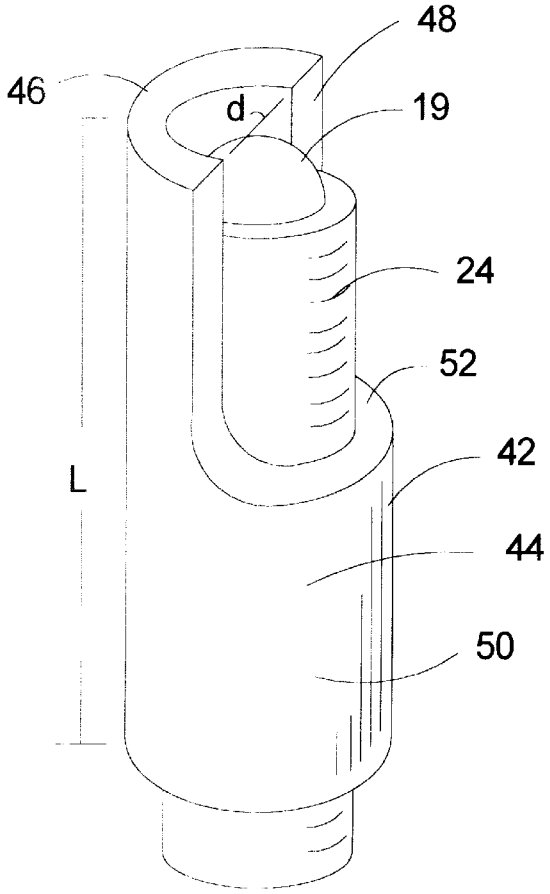
FIG. 16 is a perspective view of a plunger with silencer for use in the ring member of FIG. 15.

Another embodiment of the ring member 11 is illustrated in plan view in FIG. 15. In this embodiment, the interior periphery 20 of the ring 12 has scallops 40 between the plungers 22. This allows the ring 12 to have sufficient thickness near a plunger 22 to support both the plunger and its associated locking screw 17. Because the thickness D of the ring 12 is minimized, the locking screws 17 can extend from the first side 14 of the ring 12 to the plungers 22. A plunger can be locked in place simply by securing one locking screw 17. At the same time, the scallops 40 provide additional area in the central opening 13 so that arrows with relatively large fletches can pass through the central opening 13.

Tubular silencers 42 on the plungers prevent a scraping sound when an arrow is drawn in the bow. When a bow with an arrow stabilizer apparatus is used in hunting it is important to avoid or minimize sounds that might alarm a deer or other animal. Drawing an arrow prior to shooting may cause an unwanted sound when the surface of the arrow is drawn along the plungers. The tubular silencers 42 prevent this unwanted noise. A tubular silencer 42 comprises an elastomeric tube 44 of silicone rubber or other suitable material. Silencer 42 has a diameter d sufficient to allow the silencer to fit snugly on a plunger 24 and a length L such that an inside end 46 can be positioned adjacent the tip member 19 of the plunger 24. A cut away section 48 extends from about half the diameter d, that is, the cut away section bisects the tube 44 at the inside end 46, and curves to a side 50 of the tube 44 about halfway along the length L of the tube 44. The cut away section 48 forms and edge 52 that may be arced, for example elliptical. The edge 52 may also be straight. The inside end 46 is oriented on the plunger so that the end 46 faces the direction the arrow will travel when the arrow is shot from the bow. Thus as the arrow is drawn back, the inside end 46 may be pulled bask against the tip member 19 of the plunger, covering the tip member with a slick, elastomeric, sound-dampening material. When the arrow is released, the inside end bends forward, thereby minimizing any frictional loss of energy as the arrow is shot from the bow. Silencers 42 may be placed on one or more of the plungers. Preferably, silencers 42 are placed on each plunger against which an arrow would ordinarily rest under the force of gravity when the bow is held in a normal shooting position. In the illustrated embodiment, these plungers would be the two lower plungers 24, 26. A silencer on the upper plunger 22 would be unnecessary.

Although the invention has been described in terms of a preferred embodiment, it will be obvious to those skilled in the art that alterations, deletions and additions may be made to the preferred embodiment without departing from the spirit and scope of the invention as set forth in the claims.

What is claimed is:

1. An arrow stabilizer apparatus for an archery bow comprising:

a planar ring member having a first side and a second side, said ring member defining an interior bounded by said ring member;

a plurality of spring-biased arrow stabilizer members coupled to said ring member and located within the interior of said ring;

a locking apparatus associated with at least one of said arrow stabilizer members, said locking apparatus extending from one of said sides through said ring to said stabilizer member, and a support member coupling said ring member to said bow.

2. The arrow stabilizer apparatus of claim 1 wherein said locking apparatus is a setscrew oriented generally perpendicularly to said arrow stabilizer member.

3. The arrow stabilizer apparatus of claim 2 wherein said setscrew has a deformable tip that contacts said arrow stabilizer member.

4. The arrow stabilizer apparatus of claim 1 further comprising a locking apparatus associated with each arrow stabilizer member and each locking apparatus requires only a single action to engage the locking apparatus.

5. The arrow stabilizer apparatus of claim 4 wherein said locking apparatus are locking screws, each locking screw having a deformable tip.

6. The arrow stabilizer apparatus of claim 1, wherein said ring member comprises a support arm slidingly received in an aperture in said support member and said support member comprises a clamp for securing said ring member is a desired location.

7. The arrow stabilizer apparatus of claim 6 wherein said clamp comprises a slot in said support member, said slot communicating with said aperture and being closed by a single screw.

8. The arrow stabilizer apparatus of claim 1, wherein said support member comprises a slot for adjusting the distance of said ring from said archery bow, a single screw received in said slot for attaching said support member to said archery bow, and a protuberance offset from said slot, said protuberance engaging said bow and inhibiting rotation of said support member around said single screw.

9. The arrow stabilizer apparatus of claim 8 wherein said protuberance comprises a setscrew.

10. The arrow stabilizer apparatus of claim 1, wherein said ring member comprises a plurality of threaded holes for coupling said spring-biased arrow stabilizer members to said ring and wherein at least one of said spring-biased arrow stabilizer members comprises a threaded exterior for engaging one of said threaded holes of said ring member.

11. The arrow stabilizer apparatus of claim 1 wherein said ring member further comprises an interior periphery, said interior periphery having at least one scallop extending outwardly between adjacent arrow stabilizer members.

12. The arrow stabilizer apparatus of claim 11, wherein said ring member comprises a plurality of threaded holes for coupling said spring-biased arrow stabilizer members to said ring, said threaded holes extending radially through a thickened region of said ring member adjacent said scallops and wherein at least one of said spring-biased arrow stabilizer members comprises a threaded exterior for engaging one of said threaded holes of said ring member.

13. The arrow stabilizer apparatus of claim 12, wherein said locking apparatus is a locking screw oriented generally perpendicularly to said arrow stabilizer member and each of said locking screws has a deformable tip for contacting a threaded exterior of said arrow stabilizer apparatus.

14. The arrow stabilizer apparatus of claim 1 further comprising a tubular silencer received on at least one of said arrow stabilizer members.

15. The arrow stabilizer apparatus of claim 14 wherein said tubular silencer comprises an elastomeric tube.

16. The arrow stabilizer apparatus of claim 15 wherein said elastomeric tube has an inside end distal from said ring member and wherein said inside end has a cut away section.

17. The arrow stabilizer apparatus of claim 16 wherein said tube has a diameter and a length and wherein said cut away section extends from about a midpoint of the diameter at the inner end of said tube to about a midpoint of the length of said tube.

18. The arrow stabilizer apparatus of claim 17 wherein said cut away section is arced.

19. The arrow stabilizer apparatus of claim 16 wherein said cut away section faces away from the bow when said arrow stabilizer apparatus is mounted on said bow.

20. The arrow stabilizer apparatus of claim 19 further comprising three arrow stabilizer members, said arrow stabilizer members extending radially inwardly from said ring member, at least two of said members angled upwardly from a horizontal plane, each of said at least two members having a tubular silencer mounted thereon.

21. An arrow stabilizer apparatus for an archery bow comprising:

a planar ring member having a first side and a second side, and an interior periphery, a plurality of spring-biased arrow stabilizer members coupled to said ring member and located within the interior of said ring; and a support member coupling said ring member to said bow, said interior periphery having at least one scallop extending outwardly between adjacent arrow stabilizer members.

22. The arrow stabilizer apparatus of claim 21, wherein said ring member comprises a plurality of threaded holes for coupling said spring-biased arrow stabilizer members to said ring, said threaded holes extending radially through a thickened region of said ring member adjacent said scallops and wherein at least one of said spring-biased arrow stabilizer members comprises a threaded exterior for engaging one of said threaded holes of said ring member.

23. An arrow stabilizer apparatus for an archery bow comprising:

a planar ring member having a first side and a second side, said ring member defining an interior bounded by said ring member;

a plurality of spring-biased arrow stabilizer members coupled to said ring member and located within the interior of said ring;

a support member coupling said ring member to said bow, and a tubular silencer received on at least one of said arrow stabilizer members.

24. The arrow stabilizer apparatus of claim 23 wherein said tubular silencer comprises an elastomeric tube.

25. The arrow stabilizer apparatus of claim 24 wherein said elastomeric tube has an inside end distal from said ring member and wherein said inside end has a cut away section.

26. The arrow stabilizer apparatus of claim 25 wherein said tube has a diameter and a length and wherein said cut away section extends from about a midpoint of the diameter at the inner end of said tube to about a midpoint of the length of said tube.

27. The arrow stabilizer apparatus of claim 26 wherein said cut away section is arced.

28. The arrow stabilizer apparatus of claim 25 wherein said cut away section faces away from the bow when said arrow stabilizer apparatus is mounted on said bow.

29. The arrow stabilizer apparatus of claim 28 further comprising three arrow stabilizer members, said arrow stabilizer members extending radially inwardly from said ring member, at least two of said members angled upwardly from a horizontal plane, each of said at least two members having a tubular silencer mounted thereon.

* * * * *

UNITED STATES PATENT AND TRADEMARK OFFICE

CERTIFICATE OF CORRECTION

PATENT NO. : 6,557,541 B2
DATED : May 6, 2003
INVENTOR(S) : Julian J. Pinto, Jr.

It is certified that error appears in the above-identified patent and that said Letters Patent is hereby corrected as shown below:

Title page,
Item [76], Inventor, the name of the inventor is -- Julian J. Pinto, Jr. -- rather than "Julian P. Pinto, Jr."

Signed and Sealed this

Second Day of September, 2003

JAMES E. ROGAN
*Director of the United States Patent and Trademark Office*